US008764327B2

(12) United States Patent
Yamada et al.

(10) Patent No.: US 8,764,327 B2
(45) Date of Patent: Jul. 1, 2014

(54) ROLL PAPER SUPPLY MECHANISM AND ROLL PAPER PRINTER

(75) Inventors: Masahiko Yamada, Omi-mura (JP); Nobuhiro Inoue, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 944 days.

(21) Appl. No.: 12/716,218

(22) Filed: Mar. 2, 2010

(65) Prior Publication Data

US 2010/0221054 A1 Sep. 2, 2010

(30) Foreign Application Priority Data

Mar. 2, 2009 (JP) ..... 2009-047671

(51) Int. Cl.

| | |
|---|---|
| ***B65H 75/00*** | (2006.01) |
| ***B65H 16/02*** | (2006.01) |
| ***B65H 16/08*** | (2006.01) |
| ***B41J 15/04*** | (2006.01) |

(52) U.S. Cl.
USPC ..... 400/242; 400/611; 400/613

(58) Field of Classification Search
USPC ..... 400/242, 611, 613; 242/590, 596.8, 242/598, 598.3
See application file for complete search history.

(56) References Cited

U.S. PATENT DOCUMENTS

| | | | | |
|---|---|---|---|---|
| 5,279,472 | A | 1/1994 | Hongo et al. | |
| 5,884,861 | A * | 3/1999 | Hosomi et al. | 242/563 |
| 6,622,953 | B2 * | 9/2003 | Inana et al. | 242/348 |
| 7,753,606 | B2 | 7/2010 | Maekawa | |
| 2003/0170065 | A1 * | 9/2003 | Kim et al. | 400/718 |
| 2005/0232677 | A1 | 10/2005 | Ogawa et al. | |
| 2007/0147936 | A1 * | 6/2007 | Ando et al. | 400/579 |

FOREIGN PATENT DOCUMENTS

| | | | | |
|---|---|---|---|---|
| JP | 03-084151 | U | 8/1991 | |
| JP | 2005-193526 | * | 1/2004 | B41J 11/70 |
| JP | 2005-306535 | A | 11/2005 | |
| JP | 2006-232474 | * | 9/2006 | B65H 23/035 |
| JP | 2007-160801 | A | 6/2007 | |
| JP | 2007-161456 | A | 6/2007 | |
| JP | 2007-203563 | A | 8/2007 | |
| JP | 2007-203564 | A | 8/2007 | |
| JP | 2007-320107 | A | 12/2007 | |

* cited by examiner

*Primary Examiner* — Ren Yan
*Assistant Examiner* — Marissa Ferguson Samreth
(74) *Attorney, Agent, or Firm* — Kilpatrick Townsend & Stockton LLP

(57) ABSTRACT

A roll paper supply mechanism reliably prevents roll paper from rising from a desired position. The roll paper supply mechanism 3 of a roll paper printer 1 has an urging member 41 that urges the round end surface of the roll paper 2 to the roll paper guide 33 defining one side of the roll paper storage unit 31. The urging surface 41*a* of the urging member 41 is inclined to the inside in the pulling direction A of the recording paper 2*a* that is pulled from the roll paper 2. When seen from the side of the width of the roll paper storage unit 31, the urging surface 41*a* is disposed between a vertical line V through the center of gravity G of the roll paper and the recording paper pulling position D, and urges an outside edge part 2*d* of the roll paper 2 at a position above the recording paper pulling position D. Because the urging surface 41*a* prevents the roll paper 2 from rising in the direction in which the recording paper 2*a* is pulled from the roll paper 2, and produces a moment centered on the urging position that prevents the roll paper 2 from rising, the roll paper 2 can be reliably prevented from rising and from bouncing up and down.

6 Claims, 3 Drawing Sheets

ROLL PAPER SUPPLY MECHANISM AND ROLL PAPER PRINTER

This application claims priority to Japanese Patent Application No. 2009-047671, filed Mar. 2, 2009, the entirety of which is incorporated by reference herein.

BACKGROUND

1. Technical Field

The present invention relates to a roll paper supply mechanism that stores roll paper so that it can roll on its side in a roll paper storage unit, and delivers and conveys a continuous web of recording paper from the roll paper storage unit to a printing position of a printer, for example. More particularly, the invention relates to a roll paper supply mechanism and to a roll paper printer having a roll paper supply mechanism that is configured so that the roll paper does not lift up from the bottom of the roll paper storage unit or a feed-out roller disposed at the bottom of the roll paper storage unit.

2. Related Art

Roll paper printers such as those used to print receipts and tickets use roll paper, which is a continuous length of recording paper wound into a roll, as the recording medium, and typically have a so-called drop-in loading type of roll paper storage unit as a roll paper supply mechanism. The roll paper is simply dropped from above and loaded into the roll paper storage unit so that the roll paper can roll on its side, and the roll paper supply mechanism delivers and conveys the continuous web of recording medium from the roll paper to the printing position. The recording paper delivered from the roll paper stored in the drop-in type roll paper storage unit is set threaded through a transportation path passed the paper feed rollers and printing position to the paper exit, and as the recording medium is conveyed by the paper feed rollers, the roll paper rolls on its side inside the roll paper storage unit (also referred to as a roll paper compartment) as the recording medium is delivered downstream.

If the roll paper shifts sideways as the recording medium is pulled from the roll, problems such as the recording paper becoming skewed and the paper feed load varying can occur. More particularly, when the widthwise position of the roll paper is limited only by left and right roll paper guides that determine the roll paper storage width in the roll paper compartment, and the widthwise position of the recording medium is not guided on the transportation path passed the printing position, the roll paper must be stored so that it does not shift sideways inside the roll paper compartment.

The round end faces of the roll paper are therefore commonly urged by an elastic member so that there is no side ways play or shifting widthwise to the paper. In addition, so that the roll paper is not held at an elevated position by the elastic force of the elastic member when the roll diameter decreases and the roll paper becomes light, the roll paper is urged with a strong elastic force when the roll diameter is large, and the roll paper is urged by a weaker elastic force when the roll diameter becomes small. Japanese Unexamined Patent Appl. Pub. JP-A-2005-306535 teaches a roll paper holding mechanism having this type of elastic member.

With a drop-in type roll paper compartment it is also necessary to cause the roll paper to roll and to deliver the recording paper in resistance to the inertial load of the roll paper and the friction between the roll paper and the bottom of the roll paper compartment. If the paper feed speed is increased, the paper feed load that works on the paper feed rollers also increases accordingly, possibly resulting in paper feed slippage and a drop in paper feed precision. Therefore, in order to reduce the paper feed load and feed the paper with precision, Japanese Unexamined Patent Appl. Pub. JP-A-2007-203563 and Japanese Unexamined Patent Appl. Pub. JP-A-2007-203564 teach roll paper supply mechanisms that have a delivery roller for causing the roll paper to rotate in the delivery (that is, the paper feed) direction disposed at the bottom of the roll paper compartment.

Even with the roll paper supply mechanism having a delivery roller as taught in JP-A-2007-203563 and JP-A-2007-203564, however, the roll paper must be urged widthwise by an elastic member in order to prevent the roll from shifting sideways because the width of the roll paper compartment is set slightly greater than the width of the roll paper in order to accommodate deviations in the roll paper width. If in this configuration the urging force of the elastic member that is used to prevent sideways movement holds the roll paper above the bottom of the roll paper compartment when the roll diameter decreases and the roll paper becomes light, the roll paper will separate from the delivery roller and causing the roll paper to roll and delivering the recording paper may not be possible.

Providing an elastic member that pushes against the roll paper with a strong elastic force when the roll diameter is large and pushes against the roll paper with a weak elastic force when the roll diameter becomes small as taught in JP-A-2005-306535 is therefore preferable to prevent the roll paper from being held above the delivery roller when the roll diameter becomes small.

However, even when the urging force of the elastic member decreases in accordance with the decrease in the roll diameter of the roll paper as taught in JP-A-2005-306535, the roll paper cannot be reliably prevented from being held in the raised position. For example, if the force whereby the recording paper is pulled from the roll paper by the paper feed roller, for example, works on the roll paper as a moment in a direction lifting the roll paper up, the likelihood is high that the roll paper will lift up easily. As a result, if the position where the elastic member urges the roll paper is not set appropriately, and only the strength of the urging force is simply controlled according to the roll diameter, the roll paper cannot be reliably prevented from rising up off the bottom or delivery roller.

With a roll paper supply mechanism having a delivery roller, the delivery force of the delivery roller works on the roll paper stored in the roll paper compartment, and the pulling force of the paper feed roller disposed downstream in the printer works at the position where the recording paper is pulled from the roll paper. The roll paper therefore easily rises off of the delivery roller when the roll diameter decreases and the roll paper become slight, and if the urging force of the elastic member decreases, the roll paper can be lifted even more easily off of the delivery roller.

Furthermore, even when the roll diameter is large and the roll paper is heavy, if the recording paper pulling force and the delivery force work on the roll paper as a moment in the direction lifting the roll paper up, the likelihood of the roll paper lifting up is high. The roll paper therefore cannot be reliably prevented from rising away from the delivery roller even if a roll paper supply mechanism having a delivery roller is used if the strength of the urging force alone is simply controlled according to the roll diameter and the urging position of the elastic member against the roll paper is not also set appropriately.

SUMMARY

A roll paper supply mechanism and a roll paper printer having a roll paper supply mechanism according to the present invention can reliably prevent the roll paper from rising up by appropriately disposing an urging member used for eliminating play widthwise to the roll paper.

A first aspect of the invention is a roll paper supply mechanism including a roll paper storage unit that stores roll paper so that the roll paper can roll; and an urging member having an urging surface that urges at least one of the left and right end surfaces of the roll paper stored in the roll paper storage unit. The urging surface is disposed horizontally between a vertical line through the center of gravity of the roll paper and the recording paper pulling position of the roll paper, and vertically so that the urging surface can urge an outside circumference edge part of the roll paper above the recording paper pulling position.

In this aspect of a roll paper supply mechanism according to the invention, the urging surface of the urging member is disposed between a vertical line through the center of gravity of the roll paper and the recording paper pulling position. As a result, the recording paper pulling force acts as a moment in the direction pushing the roll paper to the bottom of the roll paper storage unit centered on the urging position of the urging surface, and the weight of the roll paper also acts as a moment pushing the roll paper to the bottom. The roll paper is prevented from lifting up or moving up and down by the produced moments.

In addition, the urging surface of the urging member is an inclined surface that slopes to the inside in the roll paper pulling direction. The urging surface therefore contacts the outside edge part of the roll paper at a position above the recording paper pulling position. As a result, when the roll paper is pulled in the roll paper pulling direction, the inclined surface (urging surface) of the urging member produces a restraining force on the roll paper in the opposite direction as the pulling direction. The combined effect of these produced moments and the restraining force of the inclined surface (urging surface) can therefore reliably prevent the roll paper from floating or moving up and down, and can hold the roll paper in a constantly stable position.

Preferably, the urging member includes a pair of left and right urging members that respectively urge the round left and right end surfaces of the roll paper, have substantially the same shape, and are disposed at substantially symmetrical left and right positions. With this aspect of the invention the roll paper can be urged by urging members from both sides and held in a stable position.

The roll paper supply mechanism of the invention is particularly effective when a delivery roller for delivering the roll paper in the supply direction is disposed in the roll paper storage unit. In this configuration, the roll paper supply mechanism also has a delivery roller that rotates the roll paper stored in the roll paper storage unit in a supply direction, and contacts an outside surface part of the roll paper at a position in the horizontal direction on the opposite side of the vertical line as the recording paper pulling position.

When thus configured, the delivery (supply) force of the delivery roller produces a moment in the direction pushing the roll paper to the bottom centered on the urging position of the urging member. The roll paper can therefore be reliably prevented from lifting up in the roll paper storage unit and separating from the delivery roller, and the roll paper supply operation can be executed stably.

The urging member may be disposed protruding to the inside from the inside width surface of a pair of roll paper guides that define the roll paper storage width of the roll paper storage unit.

A printer according to another aspect of the invention has the roll paper supply mechanism described above.

The widthwise position of recording paper that is pulled from a roll paper compartment and conveyed passed a printing position in a roll paper printer is often controlled only by a pair of left and right roll paper guides in the roll paper compartment. If the roll paper becomes lifted up inside the roll paper compartment and is not held in a stable position, the recording paper pulled off the roll may become skewed, thus leading to such problems as paper jamming or a drop in print quality. The invention can prevent such problems.

Effect of the Invention

In a roll paper supply mechanism according to the invention, the urging surface of an urging member that suppresses sideways (widthwise) movement of roll paper stored in a roll paper storage unit (roll paper compartment) is an inclined surface that slopes to the inside of the roll paper storage unit in the roll paper pulling direction, and the urging surface is disposed so that it urges an outside circumference edge part of the roll paper at a position above the recording paper pulling position and between the recording paper pulling position and a vertical line through the center of gravity of the end surface of the roll. By thus configuring the shape of the urging surface and the urging position, the roll paper can be prevented from rising and can be prevented from moving up and down. Problems such as a drop in print quality in a roll paper printer due to skewing of the recording paper pulled from the roll paper, for example, can therefore be prevented.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of a roll paper printer according to the invention is described below with reference to the accompanying figures.

Figure 1:
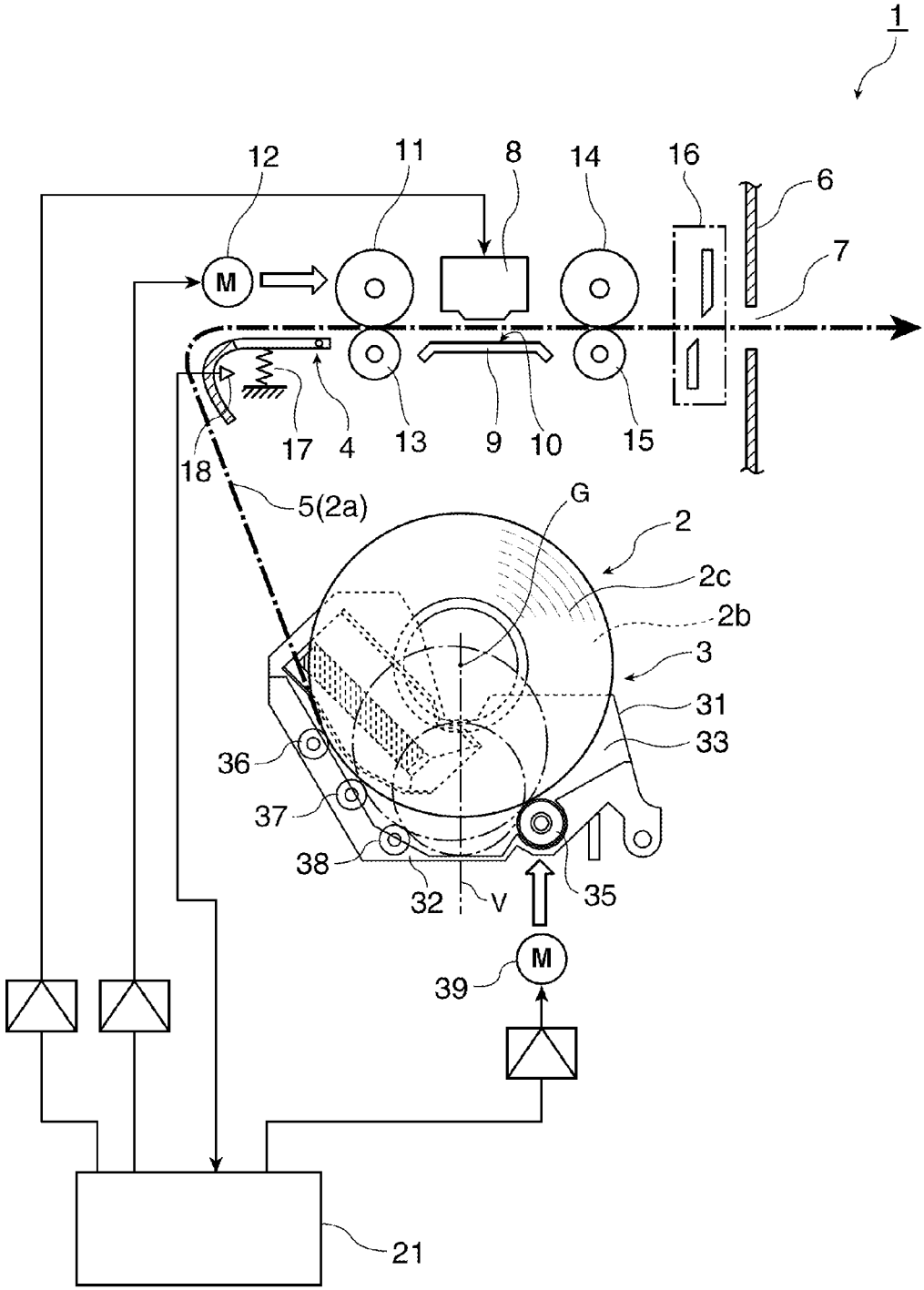
FIG. 1 schematically describes the configuration of a roll paper printer according to the invention.

FIG. 1 schematically describes the configuration of a roll paper printer according to the invention. The roll paper printer 1 has a roll paper supply mechanism 3. Roll paper 2, which has a continuous web of recording paper 2*a* (denoted by a bold dot-dash line in the figure) wound into a roll, is stored in the roll paper supply mechanism 3. The continuous recording paper 2*a* that is delivered from the roll paper 2 stored in the roll paper supply mechanism 3 is pulled diagonally upward and wound around a curved tension guide 4, and then conveyed through a transportation path 5 that extends horizontally (the same path as the dot-dash line denoting the recording paper 2*a*) and discharged from a paper exit 7 formed in the printer case 6.

The part of the transportation path 5 that extends horizontally is positioned directly above the roll paper supply mechanism 3. An inkjet head 8 and platen 9 are disposed in mutual opposition with a constant gap therebetween in this part of the transportation path, and the printing position 10 of the inkjet head 8 is determined by the platen 9.

An upstream-side paper feed roller 11 is disposed to the transportation path 5 on the upstream side of the inkjet head 8, and the upstream-side paper feed roller 11 is driven rotationally by a paper feed motor 12. A pressure roller 13 is pressed against the upstream-side paper feed roller 11 to rotate in conjunction therewith. A downstream-side paper feed roller 14 that rotates in synchronization with the upstream-side paper feed roller 11 is disposed on the downstream side of the inkjet head 8, and a pressure roller 15 is pressed against the downstream-side paper feed roller 14 to rotate in conjunction therewith.

An automatic cutter 16 is disposed near the paper exit 7, and is configured to cut the leading end part of the printed recording paper 2*a* widthwise to a specific length.

The tension guide 4 is attached to the printer frame not shown so that the tension guide 4 can move within a specific range, and is constantly urged in the direction applying tension to the recording paper 2*a* by a spring member 17. As a result, the tension on the recording paper 2*a* pulled along the transportation path 5 is held constant.

A guide sensor 18 is disposed near the tension guide 4, and if slack occurs in the recording paper 2*a* and the tension guide 4 moves in the urging direction of the spring member 17, this movement is detected by the guide sensor 18.

The roll paper supply mechanism 3 has a roll paper storage unit 31 that is open to the top.

The roll paper storage unit 31 has a bottom plate 32 that extends widthwise to the printer, and left and right roll paper guides 33 and 34 disposed on opposite sides of the bottom plate 32. One delivery roller 35 and a plurality of guide rollers are disposed to the bottom plate 32. This embodiment of the invention has three guide rollers, that is, first to third guide rollers 36, 37, and 38. These rollers 35 to 38 are disposed with the axis of rotation aligned with the width of the printer, that is, widthwise to the printer. The delivery roller 35 is driven rotationally by the delivery motor 39. The three guide rollers, first to third guide rollers 36, 37, and 38, are attached freely rotationally to the bottom plate 32.

The drive control unit 21 of the roll paper printer 1 controls driving other parts based on commands from a host device such as a computer system not shown. During the printing operation the paper feed motor 12 is driven to rotationally drive the downstream-side paper feed roller 14 and the upstream-side paper feed roller 11, and synchronized therewith rotationally drive the delivery motor 39 of the roll paper supply mechanism 3, to convey the recording paper 2*a*. The drive control unit 21 also drives the inkjet head 8 synchronized to recording paper 2*a* transportation to print on the surface of the recording paper 2*a* passing the printing position 10. After printing is completed, the automatic cutter 16 is driven to cut the recording paper 2*a*. As a result, a receipt or ticket, for example, of a desired length obtained by cutting the recording paper 2*a* is discharged from the paper exit 7.

The drive control unit 21 controls driving the delivery roller 35 of the roll paper supply mechanism 3 synchronized to the upstream-side paper feed roller 11 and the downstream-side paper feed roller 14 so that the recording paper 2*a* is conveyed with no slack and specific tension applied thereto based on the detection signal from the guide sensor 18.

Roll Paper Storage Mechanism

Figure 2B:
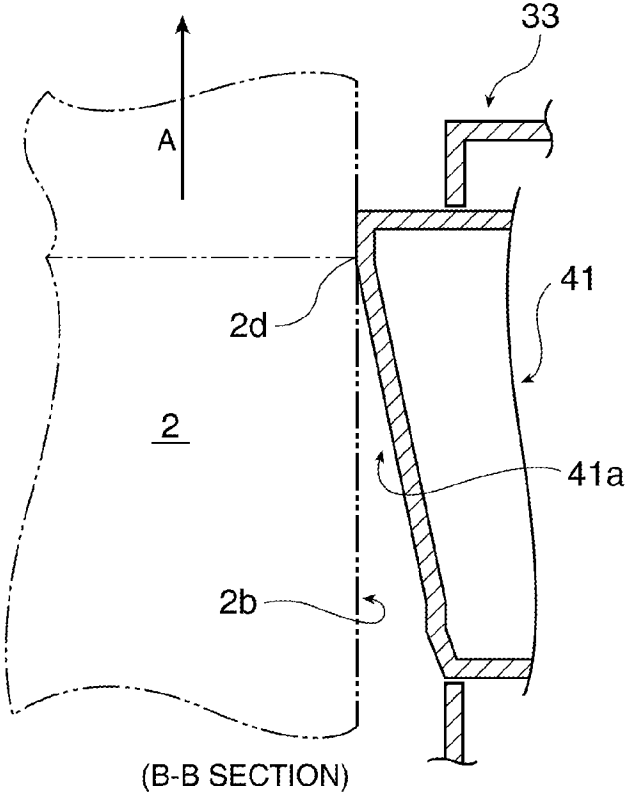
FIG. 2 describes one roll paper guide of the roll paper supply mechanism shown in FIG. 1.
Figure 2A:
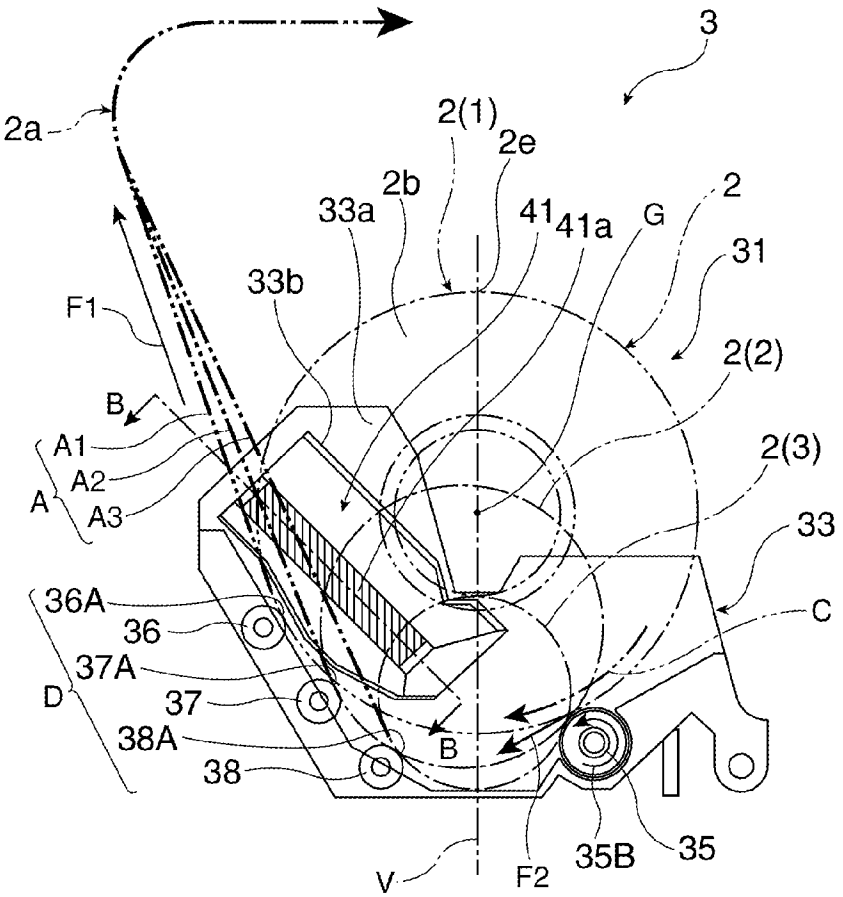
Figure 3:
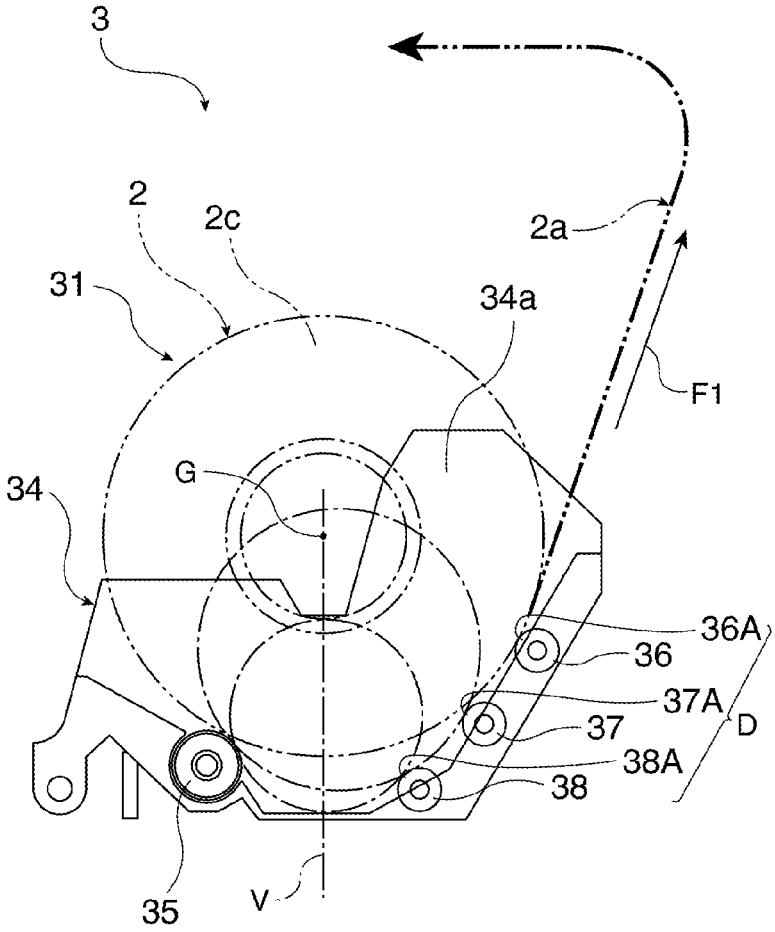
FIG. 3 describes the other roll paper guide of the roll paper supply mechanism shown in FIG. 1.
Figure 4:
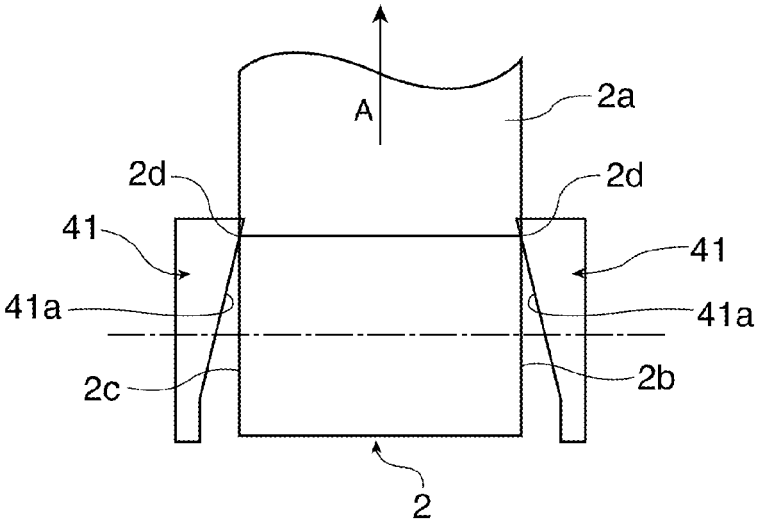
FIG. 4 describes an example in which urging members are disposed on both sides.

FIG. 2A shows the roll paper supply mechanism 3 from the side of roll paper guide 33. FIG. 2B is a section view through line B-B in FIG. 2A. FIG. 3 shows the other roll paper guide 34.

As shown in FIG. 3, the one roll paper guide 34 of the roll paper storage unit 31 has a flat vertical side surface 34*a* that opposes one round end face 2*c* of the roll paper 2. In contrast, as shown in FIG. 2, the other roll paper guide 33 has a flat vertical side surface 33*a* that opposes the other round end face 2*b* of the roll paper 2, and an urging member 41 that protrudes to the round end face 2*b* side of the roll paper 2 through a window 33*b* opened in the vertical side surface 33*a*.

The urging member 41 is trapezoidal in section view, and is disposed to the roll paper guide 33 movably widthwise to the roll paper storage unit 31, that is, in the direction moving to and away from the round end face 2*b* of the roll paper. The urging member 41 is also urged from the back to the inside widthwise (that is, to the side towards the round end face 2*b* of the roll paper) by a spring member not shown.

The distal end surface of the urging member 41 protruding from the vertical side surface 33*a* of roll paper guide 33 is a flat, narrow, long, and rectangular urging surface 41*a* (the part that is shaded in FIG. 2A). The gap between this urging surface 41*a* and the vertical side surface 34*a* of the other roll paper guide 34 is slightly less than the width of the roll paper 2. Therefore, when the roll paper 2 is inserted from above into the roll paper storage unit 31, the urging member 41 is pushed slightly to the outside, and the roll paper 2 is held by the spring force with no sideways play between the urging surface 41*a* of the urging member 41 and the vertical side surface 34*a* of the other roll paper guide 34.

Relative Positions of the Rollers

The relative positions of the delivery roller 35 and the first to third guide rollers 36, 37, and 38 are described next with reference to FIG. 2A and FIG. 3.

When the roll paper 2 is loaded so that it can roll freely on its side in the roll paper storage unit 31 and is seen from the side of the roll paper storage unit 31 (horizontally to the roll paper storage unit), that is, in line with the center axis of the roll paper 2, the first to third guide rollers 36, 37, and 38 are disposed on the out-feed side (that is, the downstream side in the transportation direction) of the recording paper 2*a* relative to a vertical line V passing through the center of gravity G of the roll paper 2, and the delivery roller 35 is disposed on the opposite side of vertical line V. When the delivery roller 35 is rotationally driven in the direction of arrow 35B, the roll paper 2 turns in the direction (in the direction of arrow C) feeding the paper from the delivery roller 35 sequentially passed the third, second, and first guide rollers 38, 37, and 36, and the recording paper 2*a* is pulled out from the position in contact with the first guide roller 36.

The delivery roller 35 is thus on the opposite side of a vertical line V passing through the center of gravity G of the roll paper 2 as the position from which the recording paper 2*a* is pulled off the roll. Even if the roll paper 2 lifts off any of the guide rollers 36, 37, and 38 due to the action of the pulling force applied to pull the recording paper 2*a*, the roll paper 2 is held sitting on the delivery roller 35, and the contact pressure between the roll paper 2 and the delivery roller 35 is maintained by the weight of the roll paper 2. As a result, the delivery roller 35 can constantly and reliably cause the roll paper 2 to rotate.

Furthermore, while the outside diameter of the roll paper 2 decreases from the maximum diameter denoted by circle 2(1) in the figure to an intermediate diameter denoted by circle 2(2), the roll paper 2 is supported by the delivery roller 35 and the guide roller farthest therefrom, that is, the first guide roller 36, and does not touch the second and third guide rollers 37 and 38.

While the outside diameter of the roll paper 2 decreases from the intermediate diameter 2(2) to an even smaller diameter denoted by circle 2(3), the roll paper 2 is supported by the delivery roller 35 and the second guide roller 37, and does not touch the first and third guide rollers 36 and 38.

When the roll paper 2 decreases to the smallest diameter denoted by circle 2(3), the roll paper 2 is supported by the delivery roller 35 and the third guide roller 38, and does not touch the first and second guide rollers 36 and 37.

The pulling position D of the recording paper 2*a* from the roll paper 2 therefore changes sequentially with the decrease in the roll diameter from the contact position 36A of the outside surface of the roll paper with the first guide roller 36, the contact position 37A with the second guide roller 37, and then the contact position 38A with the third guide roller 38.

As described above, the roll paper 2 is thus always supported by the delivery roller 35 and at least one of the first to third guide rollers 36, 37, and 38 even as the outside diameter of the roll changes. The roll paper 2 will therefore not separate from the delivery roller 35. Contact pressure between the roll paper 2 and the delivery roller 35 is therefore maintained by the weight of the roll paper 2, and the roll paper 2 is reliably driven rotationally by the delivery roller 35.

In addition, because change in the rotational load is smaller when the outside surface of the roll paper 2 contacts a guide roller 36 to 38 than when the outside surface directly contacts the bottom of the roll paper storage unit 31, and the side pressure of the urging surface 41*a* of the urging member 41 together with a small rotational load work to squeeze the roll paper 2, the roll paper 2 is held down, shifting of the roll paper 2 can be suppressed, and the roll paper 2 can be prevented from lifting up.

Shape and Position of the Urging Surface of the Urging Member

Referring next to FIG. 2A and FIG. 2B, the urging surface 41*a* is a long, narrow, rectangular surface as described above, and is a flat inclined surface that slopes so that the top end of the long side protrudes to the inside widthwise to the roll paper storage unit 31. Therefore, when seen in the pulling direction A (direction A1 when the recording paper pulling position is at contact position 36A, direction A2 when the recording paper pulling position is at contact position 37A, or direction A3 when the recording paper pulling position is at contact position 38A) of the recording paper 2*a*, the urging surface 41*a* is an inclined surface that slopes in the pulling direction A and protrudes toward the center of the width of the roll paper storage unit 31. Note that the urging surface 41*a* is a flat inclined surface in this embodiment of the invention, but may be an inclined surface having a convex curved surface or an inclined surface having a concave curved surface.

The urging surface 41*a* of the urging member 41 is positioned between the vertical line V passing through the center of gravity G of the roll paper 2, and the roll paper pulling position D (contact positions 36A, 37A, 38A) of the recording paper 2*a* from the roll paper 2. The urging surface 41*a* in this embodiment extends at an incline of approximately 45 degrees to the vertical line V when in this in-between position, and the length of the long side and the position where it is disposed are determined so that the urging surface 41*a* can urge the outside edge part of the roll paper 2 at a position above the recording paper pulling position D (contact positions 36A, 37A, 38A).

Because the urging surface 41*a* of the urging member 41 is thus an inclined surface that slopes in the recording paper pulling direction A and to the inside width of the roll paper storage unit 31, the urging surface 41*a* is held in contact with the outside edge part of the round end face 2*b* of the roll paper 2 regardless of the roll diameter of the roll paper 2 until the roll diameter of the roll paper 2 decreases to the minimum diameter 2(3). More specifically, as shown in FIG. 2A, the urging surface 41*a* is held in contact with the outside circumference edge of the roll paper 2 at the outside edge part 2*d* thereof in the range from the recording paper pulling direction D to the top point 2*e* intersecting vertical line V.

As a result, as will be understood from FIG. 2B, the inclined urging surface 41*a* produces a restraining force that restrains the roll paper 2 in the direction in which the roll paper 2 is not pulled out and opposes the pulling force acting on the roll paper 2. The roll paper 2 is thus prevented from rising in the pulling direction A.

In addition, a moment in the direction preventing the roll paper 2 from rising acts on the roll paper 2 centered on the urging center of the urging surface 41*a* pushing against the roll paper 2. Because the roll paper 2 is held between the urging surface 41*a* and the vertical side surface 34*a* on the opposite side, the roll paper 2 rotates centered on the center (the urging center) of the contact area between the urging surface 41*a* and the round end face 2*b*. The pulling position D of the recording paper from the roll paper 2 is disposed at the outside surface of the roll paper on the opposite side of the urging center as the center of gravity G of the roll paper 2. As a result, a moment in the direction preventing the roll paper 2 from rising is applied to the roll paper 2 centered on the urging center by the pulling force F1 that works at the recording paper pulling position D (contact positions 36A, 37A, 38A) from the upstream-side paper feed roller 11 side.

The weight of the roll paper 2 also produces a moment centered on the urging center that acts on the roll paper 2 in the direction preventing the roll paper 2 from rising. In addition, because the delivery roller 35 contacts the outside surface of the roll paper on the same side of the urging center as the center of gravity G, the delivery force F2 of the delivery roller 35 also applies a moment on the roll paper 2 in the direction preventing the roll paper 2 from rising centered on the urging center.

The urging surface 41*a* of the urging member 41 in this embodiment of the invention can prevent the roll paper 2 from being pulled and lifted up in the pulling direction A. Furthermore, because force is applied to the roll paper 2 centered on the urging center of the urging surface 41*a* in the direction preventing the roll paper 2 from rising, the roll paper 2 can be prevented from lifting up and the roll paper 2 can be held constantly in contact with the delivery roller 35.

In other words, the roll paper 2 can be prevented from being lifted up even if the urging force is small. The urging force of the urging member 41 can therefore be set low so that the roll paper 2 will not be held in a raised position between the urging surface 41*a* and the round end face 2*c*.

As described above, the roll paper supply mechanism 3 of the roll paper printer 1 according to this embodiment of the invention can hold the roll paper 2 constantly in contact with the delivery roller 35 even as the roll diameter of the roll paper 2 changes. Therefore, the roll paper 2 can be rotated and the recording paper 2*a* can be delivered with a constantly stable delivery force even if the diameter of the roll paper 2 changes. The roll paper printer 1 according to this embodiment of the invention can therefore feed the recording paper with good precision, and can print at high speed without inducing a drop in print quality.

Other Embodiments

An urging member 41 is disposed to one roll paper guide 33 of the roll paper storage unit 31 in the embodiment described above, but an urging member 41 may be disposed to both roll paper guides 33 and 34. In this configuration as shown in FIG.

4, if both urging members 41 have the same shape and are disposed at left and right symmetrical positions, the roll paper 2 can be held reliably on both sides, and lifting and up and down chattering of the roll paper 2 can be reliably prevented.

Furthermore, the urging surface 41*a* of the urging member 41 is narrow, long, and rectangular in this embodiment of the invention, but the shape of the urging surface 41*a* can obviously be other than rectangular.

The left and right roll paper guides 33 and 34 are fixed roll paper guides disposed at predetermined positions in the embodiment described above, but either or both may be a movable roll paper guide that can slide widthwise to the roll paper compartment to change the roll paper storage width.

Yet further, a delivery roller 35 causes the roll paper 2 stored in the roll paper storage unit 31 to rotate in the delivery (supply) direction in this embodiment of the invention. The invention can also be applied to roll paper supply mechanisms that do not have such a delivery roller 35, and the same effect of preventing the roll paper from rising or being held at an uplifted position, suppressing vertical movement or chatter, and holding the roll paper in a stable position can be achieved.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A roll paper supply mechanism comprising:

a roll paper storage unit that stores a roll paper of a recording paper so that the roll paper can roll, wherein when unrolling the recording paper from the roll paper in the unit, the recording paper separates from the roll paper at a paper pulling position that moves relative to a vertical line extending through a center of gravity of the roll paper as the roll paper unrolls; and an urging member having an urging surface that urges at least one of a left end surface and a right end surface of the roll paper stored in the roll paper storage unit, wherein the urging member is sized such that at least a portion of the urging surface contacts the respective end surface of the roll paper as the roll paper unrolls and remains above the recording paper pulling position during unrolling of the recording paper, the urging surface being disposed horizontally between the vertical line that extends through the center of gravity of the roll paper and the recording paper pulling position of the roll paper, and vertically so that the urging surface contacts an outside circumference edge part of the roll paper above the recording paper pulling position during unrolling of the roll paper.

2. The roll paper supply mechanism described in claim 1, wherein:

the urging surface is an inclined surface that slopes toward an inside widthwise of the roll paper storage unit toward the roll paper pulling direction in which the recording paper is pulled from the roll paper.

3. The roll paper supply mechanism described in claim 1, wherein:

the urging member includes a pair of urging members that urge both left and right end surfaces of the roll paper, and are disposed to substantially symmetrical left and right positions respectively.

4. The roll paper supply mechanism described in claim 1, further comprising:

a delivery roller that rotates the roll paper stored in the roll paper storage unit in a supply direction, and contacts an outside surface part of the roll paper at a horizontal position on an opposite side of the vertical line as the recording paper pulling position.

5. The roll paper supply mechanism described in claim 1, further comprising:

a pair of roll paper guides that define a roll paper storage width of the roll paper storage unit;

wherein the urging member is disposed protruding toward an inside widthwise of the roll paper storage unit from an inside width surface of the roll paper guides.

6. A roll paper printer comprising:

the roll paper supply mechanism described in claim 1.

* * * * *